US005482117A

United States Patent [19]

Kolpak et al.

[11] Patent Number: 5,482,117

[45] Date of Patent: Jan. 9, 1996

[54] GAS-LIQUID SEPARATOR FOR WELL PUMPS

[75] Inventors: Miroslav Kolpak, Dallas; S. Michel Bucaram, Plano, both of Tex.

[73] Assignee: Atlantic Richfield Company, Los Angeles, Calif.

[21] Appl. No.: 354,535

[22] Filed: Dec. 13, 1994

[51] Int. Cl.[6] ..... E21B 43/38

[52] U.S. Cl. ..... 166/265; 166/105.5; 166/106

[58] Field of Search ..... 166/53, 68, 105, 166/106, 105.5, 266, 265, 369

[56] References Cited

U.S. PATENT DOCUMENTS

| | | | |
|---|---|---|---|
| 1,279,758 | 9/1918 | Putnam . | |
| 1,628,900 | 5/1927 | Neilsen . | |
| 2,398,339 | 4/1946 | Watts . | |
| 2,652,130 | 9/1953 | Ferguson . | |
| 2,843,053 | 7/1958 | Carle . | |
| 3,048,122 | 8/1962 | Hansen . | |
| 3,128,719 | 4/1964 | Jongbloed et al. . | |
| 3,282,031 | 11/1966 | Vos et al. | 96/214 |
| 3,299,821 | 1/1967 | Silvern | 416/175 |
| 4,231,767 | 11/1980 | Acker | 166/105.5 X |
| 4,481,020 | 11/1984 | Lee et al. | 166/105.5 |
| 4,676,308 | 6/1987 | Chow et al. | 166/369 |
| 4,726,420 | 2/1988 | Weeks | 166/68 |
| 4,766,957 | 8/1988 | McIntyre | 166/265 |
| 4,981,175 | 1/1991 | Powers | 166/265 |
| 5,154,588 | 10/1992 | Freet et al. | 166/105.5 X |
| 5,271,725 | 12/1993 | Freet et al. | 166/105.5 X |

*Primary Examiner*—Roger J. Schoeppel
*Attorney, Agent, or Firm*—Michael E. Martin

[57] ABSTRACT

A gas-liquid separator for a well pump includes a stationary helical baffle disposed in a tubular housing for separating gas from liquid and conducting gas through a center conduit disposed in the housing to a tubing string in communication with the separator or into the well annulus for flow to the surface. The baffle may be interposed in a conventional downhole submersible pump between the motor section and the pump section and the pump section may be modified to have a hollow impeller drive shaft for conducting gas separated by the separator through the pump section and out of gas discharge ports in the pump section housing. In an alternate embodiment gas is discharged from the hollow drive shaft into the tubing string and liquid separated from the gas is pumped through the pump section and out into the wellbore annulus. The baffle may have at least two stages, one of which causes some of the liquid being conducted through the separator to bypass the second separator stage and flow directly to the pump inlet so that more effective separation of gas from liquid occurs in the second stage and all of the liquid entering the pump inlet has minimal gas content.

24 Claims, 4 Drawing Sheets

GAS-LIQUID SEPARATOR FOR WELL PUMPS

FIELD OF THE INVENTION

The present invention pertains to a stationary centrifugal gas-liquid separator arrangement for motor driven submersible well pumps.

BACKGROUND

In the production of liquid hydrocarbons from wells which are not free flowing it is common practice to use electric motor driven submersible pumps or similar type pumps with downhole motors. One problem associated with the use of downhole motor driven pumps, in particular, is that the liquid being pumped can have only a limited amount of gas entrained therein without developing operating problems which may damage the pump and generally cause unsatisfactory operation. Typically the entrained gas in the pump inlet fluid flow stream cannot exceed about fifteen percent by volume.

Accordingly, devices have been developed for use with submersible or similar types of downhole pumps wherein the fluid flowing toward the pump inlet is directed to undergo reverse flow and be directed along a spiral or helical flow path to effect centrifuging of the liquid and separation of gas therefrom. Certain types of electric motor driven submersible pumps also have a spiral type inducer section disposed just upstream of the pump impeller which is rotatably driven by the pump drive motor and effects some separation of gas from liquid flowing to the pump impeller. However, this type of separator consumes additional power since it exerts work on the fluid being pumped toward the primary liquid lifting pump. U.S. Pat. Nos. 4,481,020 to Lee et al. and 4,981,175 to Powers describe examples of motor driven rotating type gas-liquid separators for submersible well pumps.

Gas-liquid separators or so-called gas anchors have also been developed for downhole well pumps which force the gas-liquid mixture to undergo spiral or helical flow to effect separation of the gas and liquid due to centrifugal forces acting thereon. U.S. Pat. Nos. 3,128,719 to Jongbloed et al.; 3,048,122 to Hansen; 2,652,130 to Ferguson; 1,628,900 to Neilsen; 1,279,758 to Putnam; 2,398,339 to Watts and 2,843,053 to Carle disclose various arrangements of gas-liquid separators which effect a somewhat spiral or helical motion to the fluid mixture to effect separation of gas and liquid. Certain improvements in helical-type gas-liquid separators for downhole applications are also described in U.S. patent application Ser. No. 08/053,581 filed Apr. 27, 1993 by Weingarten et al. now abandoned.

However, there has been a continuing desire and need to develop improvements in gas-liquid separators for use in conjunction with downhole motor driven pumps, particularly electric motor driven submersible pumps, and wherein the gas content of the fluid mixture to be pumped is in the range of anywhere from fifteen percent to fifty percent by volume. It is to this end that the present invention has been developed.

SUMMARY OF THE INVENTION

The present invention provides an improved gas-liquid separator for a downhole motor driven well pump for separating gas from liquid in the flow stream approaching the pump inlet.

In accordance with an important aspect of the invention, a gas-liquid separator is provided for a submersible well pump wherein a helical flow path of the gas-liquid mixture is provided between the fluid inlet to the pump and the pump impeller. In particular, the helical flow path is provided by a stationary helical baffle which induces centrifugal forces on the mixture approaching the pump to effect separation of gas from liquid wherein gas flows generally along the core or center of the flow path and liquid is forced toward an outer wall of the separator and flows along the outer wall toward the pump impeller. The stationary baffle does not consume any power, is configured to minimize flow losses through the separator section before the fluid is conducted to the pump impeller inlet and may be arranged to beneficially induce pre-rotation of the fluid approaching a centrifugal pump impeller.

In accordance with another aspect of the invention, an improved motor driven submersible well pump is provided having a spiral gas-liquid separator interposed between the pump motor and the fluid inlet to the pump impellers and further wherein the gas flow path for gas separated from the gas-liquid mixture includes a passage formed in an impeller drive shaft for the pump.

In accordance with yet a further aspect of the invention a centrifugal-type gas-liquid separator configuration is provided for a downhole well pump wherein gas separated from liquid is conducted through the pump impeller section and is discharged into the well annulus while liquid is allowed to flow from the impeller section through a tubing string to the surface. In an alternate embodiment of the invention the gas flow path is through the tubing string and the liquid flow path is provided in the well annulus.

In accordance with yet a further aspect of the present invention, a unique stationary, multistage gas-liquid separator is provided for a well pump wherein the gas-liquid mixture is subjected to a preliminary separation of liquid which has substantially all gas removed therefrom and wherein the separator has a second stage which operates on the portion of the mixture which has a higher gas content to more efficiently separate all of the gas from the mixture before the liquid component of the mixture is allowed to flow into the pump impeller section.

Still further, the present invention provides a downhole pumping apparatus for wells which includes an improved gas-liquid separator for well fluids flowing toward a downhole pump and wherein the separated gas may be introduced into a tubing string for conducting liquid to the surface to provide additional lifting effort to the liquid.

The present invention provides yet a further improvement in downhole gas-liquid separators for well pumps wherein an electric motor driven submersible pump is provided with a stationary helical baffle type gas-liquid separator which provides for separation of gas from liquid before the liquid is introduced into the pump impeller section. The configuration of the separator and its support housing is such that a conventional electric motor driven submersible pump may be connected to the separator without major modification to the pump. In this way conventional commercially available well pumps may enjoy the benefits of the improved spiral type gas-liquid separator of the present invention.

Those skilled in the art will further appreciate the above-mentioned features and advantages of the present invention together with other important aspects thereof upon reading the detailed description which follows in conjunction with the drawing.

DESCRIPTION OF PREFERRED EMBODIMENTS

Figure 1:
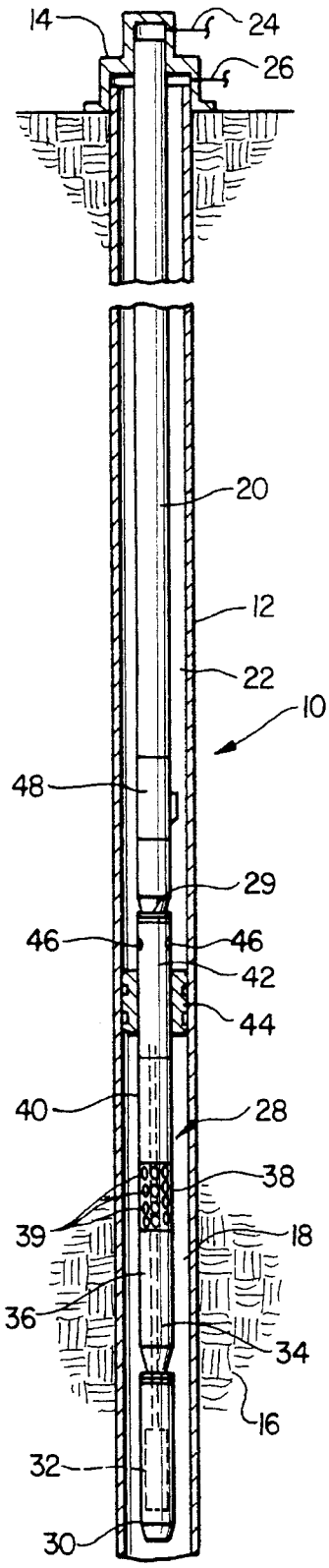
FIG. 1 is a somewhat schematic view of a well which includes a submersible motor driven pump which includes a unique gas-liquid separator in accordance with the present invention.

In the description which follows, like parts are marked throughout the specification and drawing with the same reference numerals, respectively. The drawing figures are not necessarily to scale in the interest of clarity and conciseness.

Referring to FIG. 1, there is shown a hydrocarbon fluid producing well, generally designated by the numeral 10, having a conventional casing 12 extending from a wellhead 14 to a fluid producing formation 16. The casing 12 is provided with suitable perforations, not shown, for admitting fluid into wellbore space 18 from formation 16 for production to the surface through an elongated tubing string 20 extending within the casing 12 from the wellhead 14 and defining an annulus 22 between the tubing string and the casing. Suitable flow lines 24 and 26 are disposed at the wellhead 14 for conducting liquid and gas, respectively, from the well 10.

The well 10 is configured to have an improved electric motor driven submersible pump interposed in the wellbore 18 and generally designated by the numeral 28. The pump 28 includes a conventional motor section 30 having a rotary electric motor 32 disposed therein and operable to receive electric power by way of a cable, not shown, extending from the earth's surface. The motor 32 is drivingly connected to an elongated pump drive shaft 34 which extends through a conventional protector or thrust section 36, which includes a pump thrust bearing, not shown, and an internal pressure regulator allowing for heat expansion and ambient change as the pump is operating in the well. The pump 28 is suitably connected to the tubing string 20 at 29, in a conventional manner. Still further, the pump 28 includes a generally cylindrical fluid inlet section 38, and a unique gas-liquid separator section 40 and pump impeller section 42. In particular, the gas-liquid separator section 40 and the impeller section 42 are in accordance with the present invention.

Figure 2:
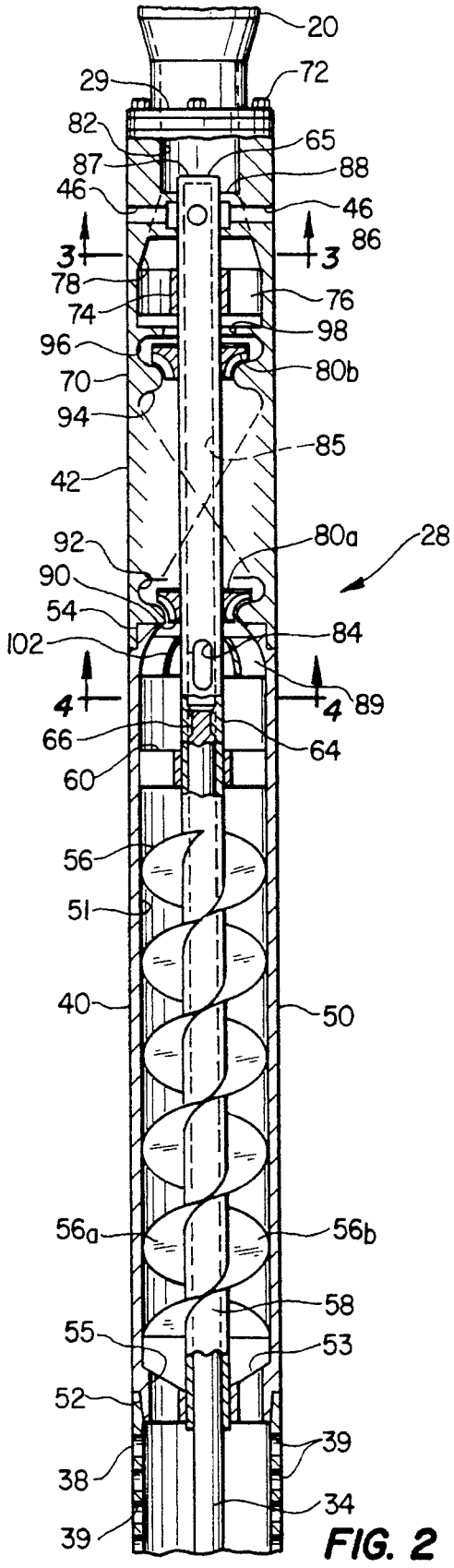
FIG. 2 is a longitudinal central section view of a portion of the pump of FIG. 1 including the pump section and the gas-liquid separator arrangement.

The inlet section 38 is primarily a generally cylindrical tubular member with plural orifices 39 formed therein, see FIG. 2 also, for admitting a gas-liquid mixture from the wellbore 18 into the gas-liquid separator section 40. As shown in FIG. 1 the pump 28 is suitably connected to a conventional well packer 44 to separate the wellbore space 18 from the annulus 22. In the arrangement of the pump 28, gas is separated from liquid flowing through the separator section 40 and is discharged from the pump section 42 through suitable ports 46 into the annulus 22 for flow up through the annulus to the wellhead 14. In a preferred arrangement of the pump 28, as well as other embodiments of the present invention, the tubing string 20 may have one or more gas lift mandrels 48 interposed therein between the wellhead 14 and the pump. In the arrangement shown in FIG. 1, the gas lift mandrel 48 is provided with conventional gas lift valving, not shown, of a type commercially available. Gas discharged from the pump 28 into the annulus 22 may flow into the tubing string 20 through the gas lift mandrel 48 to aid in lifting liquid through the tubing string 20 to the wellhead 14 for flow through the flow line 24 and subsequent re-separation downstream thereof. Gas separated in the well 10 may also be conducted up the annulus 22 and through flowline 26 for reinjection into another well, not shown, fur use in gas lift or injection into another earth formation zone.

Accordingly, a gas-liquid mixture entering the wellbore space 18 from the formation 16 has gas separated from the liquid in the pump separator section 40, and gas is conducted through the pump section 42 to the annulus 22 by way of ports 46. Liquid separated from the mixture is pumped through the tubing string 20 connected to the pump section 42 and gas may be introduced into the tubing string 20 by way of the gas lift mandrel 48, one shown, to aid in lifting the liquid to the surface. The gas lift mandrel 48 may be of a type manufactured by Halliburton Company, Dallas, Tex., and sold under the trademark Otis™ as a model "Otis B" gas lift mandrel and gas lift valve assembly. The pump 28 may also include a conventional motor section 30, thrust or protector section 36 and inlet section 38 such as manufactured by Trico Industries, Inc., Gardena, Calif. or TRW Reda Pump Division, Bartlesville, Okla.

Referring now to FIG. 2 the unique gas-liquid separator section 40 and pump section 42 of the pump 28 are illustrated in a longitudinal central section view. As shown in FIG. 2 the gas-liquid separator section 40 includes an elongated, generally cylindrical tubular housing 50 suitably connected at its lower end 52 to the inlet section 38 and at its upper end 54 to the pump section 42. The housing 50 has an elongated stationary helical baffle 56 disposed therein including a hub section comprising an elongated hollow tube 58 which extends from a lower head portion 53 of the housing to a web support member 60 disposed in and near the upper end of the housing 50. Suitable passages 55 are provided in the head 53 for admitting a gas-liquid mixture into the interior of the housing 50 for flow along a helical path defined by the baffle 56 to impose centrifugal forces on the gas-liquid mixture causing the liquid to flow generally along the inside wall 51 of the housing 50 toward the upper end 54 of the housing and eventually to the pump section 42. The baffle 56 is formed by two separate helical baffle plates or flights **56*a* and 56*b* although a single baffle may be sufficient for certain applications. The stationary tubular hub 58 is operable to journal the motor drive shaft 34 of the pump 28 which extends through the hub 58 and is in driving engagement with a pump impeller shaft 64 at suitable cooperating splines 66**.

Referring further to FIG. 2, the pump section 42 includes a generally cylindrical housing 70 suitably connected to the tubing string 20 at a transverse flange 72 and also suitably connected to the upper end 54 of the separator section 40, such as by cooperating threads, not shown. The housing 70 is adapted to support the pump impeller shaft 64 for rotation therein at a bearing 74 disposed on a stationary web 76. The web 76 is disposed within a cavity 78 formed in the housing 42. Plural centrifugal pump impellers, two shown in FIG. 2 and designated 80*a* and 80*b*, are arranged in series on the shaft 64 and are rotatably driven thereby to pump liquid through the pump section 42 for discharge into the cavity 78 and for flow through a passage 82 into the tubing string 20.

Figure 3:
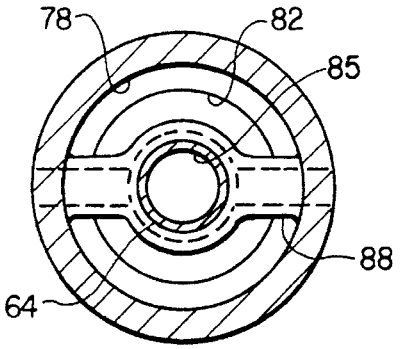
FIG. 3 is a section view taken generally from the line 3—3 of FIG. 2.

Gas separated from liquid in the separator section 40 flows along the central core portion of the separator, adjacent to the hub 58, passes through the web 60 and flows into one or more ports 84 formed in the impeller shaft 64. The impeller shaft 64 is an elongated tube which is closed at its upper end by a transverse wall 65. Adjacent the wall 65 are plural gas discharge ports 86 which open into a cylindrical recess 87 formed in a web 88, see FIG. 3, which also serves to journal the upper end of the impeller shaft 64. Accordingly, gas separated from the fluid mixture flowing through the separator section 40 may flow into the ports 84, through an interior passage 85, FIG. 3, of the tubular shaft 64, out through the ports 86 and then through the recess 87 to the ports 46 for exit from the pump section 42.

Liquid is conducted through the pump section 42 by flowing generally along the wall 51 toward a pump inlet opening 90 in the housing 50 adjacent to the first stage impeller 80*a* and liquid is then pumped through successive impeller stages, not shown, to increase the pressure thereof and is discharged from the final or last stage impeller 80*b* into the cavity 78 for flow through the passage 82 and the tubing string 20. The pump section 42 may include several pump impellers arranged spaced apart on the shaft 64 and operably interconnected for pumping liquid from one stage to the next through suitable annular passages such as the diffuser passages 92 and 94. The intermediate impeller stages of the pump 42 are not shown in the interest of clarity and conciseness. Suffice it to say that several pump impellers 80 may be arranged spaced apart on the shaft 64 in a conventional manner to receive fluid flow from the previous impeller by way of the conventional annular diffuser type passages 92 and 94. Liquid flow out of the last impeller 80*b* flows through a circumferential diffuser passage 96 and a passage 98 into the cavity 78.

Figure 4:
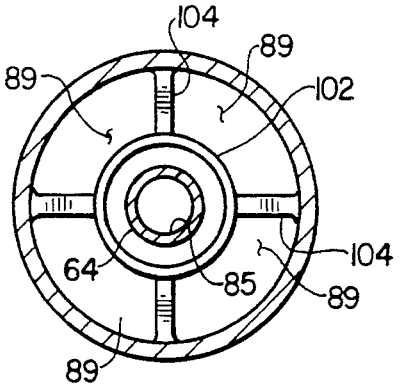
FIG. 4 is a section view taken generally from the line 4—4 of FIG. 2.

Referring to FIGS. 2 and 4, separation of gas and liquid is achieved upstream of the inlet to the first stage pump impeller 80*a* and such separation is maintained and enhanced by the provision of a generally cylindrical frusto conical diverter member 102 disposed around the shaft 64 at the ports 84 and supported on a suitable web 104, FIG. 4. Since the gas separated by the separator section 40 is tending to flow along and adjacent to the hub 58, the diverter 102 assures that substantially all of the gas passes through the ports 84 into the passage 85 and is not directed into the first stage pump impeller 80*a*. The shaft 64 extends through the diverter 102 at a suitable close fitting bore 103.

Accordingly, in the operation of the pump 28 the motor 32 drivingly rotates the shaft 34 which, in turn, rotates the shaft 64 to induce fluid flow through the intake section 38 and the gas-liquid separator section 40, whereby substantial separation of gas from liquid is effected with liquid flowing along the outer portion of the passages formed by the housing 50 and the spiral baffle 56. As both gas and liquid approach the opening 90 liquid is flowing generally along and adjacent to the inside wall 51 of the housing 50 and passes through suitable passages 89, FIG. 4, into the impeller inlet opening while gas flows generally along and adjacent to the hub 58 and enters the ports 84 with the assistance of the diverter 102. Liquid exits the last impeller stage 80*b* through the opening 98 and flows through the cavity 78, and the passage 82 to the tubing string 20. Gas flows through the interior of the shaft 64 and exits through ports 86 and then through the ports 46 into the annulus 22. If needed, gas may be conducted into the tubing string 20 through the gas lift mandrel 48 to assist in lifting the liquid to the surface. The stationary baffle 56 is configured to minimize fluid pressure losses through the separator section 40 and does not directly consume any of the power of the motor 32. It is contemplated that the power consumed by the pump impellers, considering the minimal fluid pressure losses caused by the separator section 40, would be less than the power consumed by a conventional pump with a rotating inducer section, when operating under equivalent operating conditions.

Figure 5:
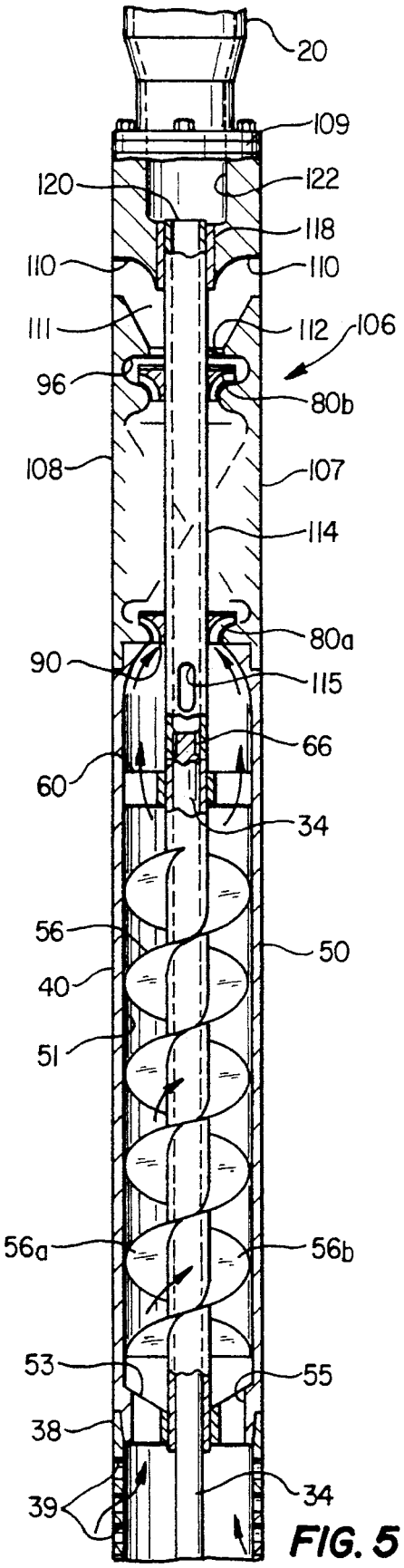
FIG. 5 is a longitudinal central section view of a first alternate embodiment of a submersible pump and gas-liquid separator according to the invention.

Referring now to FIG. 5, there is illustrated a pump 106 similar to the pump 28 but having a pump section 108 connected to the separator section 40 and to the tubing string 20 at a transverse flange 109. The pump section 108 includes a cylindrical housing 107 similar to the housing 70 but having opposed liquid discharge ports 110 in communication with a discharge opening 112 for receiving liquid from the last impeller stage 80*b* by way of diffuser passage 96. The housing 107 includes suitable passage means 111 in communication with the ports 110 and the liquid discharge opening 112.

The pump section 108 also has a modified impeller drive shaft 114 drivingly connected to the pump impellers 80*a* and 80*b* and suitably splined to the shaft 34 at cooperating splines 66. The drive shaft 114 is journalled in a suitable bearing 118 at the upper end of the housing 107. The drive shaft 114 is also formed as a hollow tube having suitable gas inlet ports 115 disposed upstream of the first stage impeller 80*a* and spaced from the impeller inlet opening 90. The opposite end of the drive shaft 114 has an outlet opening 120 in communication with a passage 122 which provides for gas to flow into the tubing string 20. Accordingly, in the configuration of the pump 106, if substituted for the pump 28, liquid is conducted up through the well annulus 22 and gas is conducted up through the tubing string 20 to the wellhead 14. The pump 106 operates in substantially the same manner as the pump 28 except that the flow paths of the fluids leaving the pump are interchanged. The pump 106 is also shown without the diverter 102 disposed just upstream of the first stage impeller opening 90. If the pump 106 is to be used in applications wherein a relatively high percentage of gas is entrained in the gas-liquid mixture and effective separation of gas and liquid is accomplished as the fluids leave the spiral flow path, substantially all of the gas may be withdrawn from the interior of the housing 50 through the ports 115 in the shaft 114 and is not induced to flow into the first stage pump impeller. However, the diverter 102 may be necessary in applications wherein the gas and liquid have not been separated into well-defined somewhat annular paths as they pass through the housing 50 between the fluid discharge end of the baffle 56 and the inlet opening 90. The position of the ports 84 and 115 in the embodiments illustrated in FIGS. 2 and 5 may also be moved further away from the inlet to the first stage impeller 80*a* to minimize inducing gas to flow on into the pump instead of into the ports 84 or 115.

Figure 7:
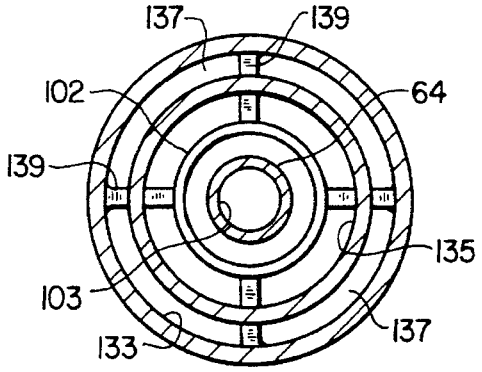
FIG. 7 is a section view taken generally along the line 7—7 of FIG. 6.
Figure 6:
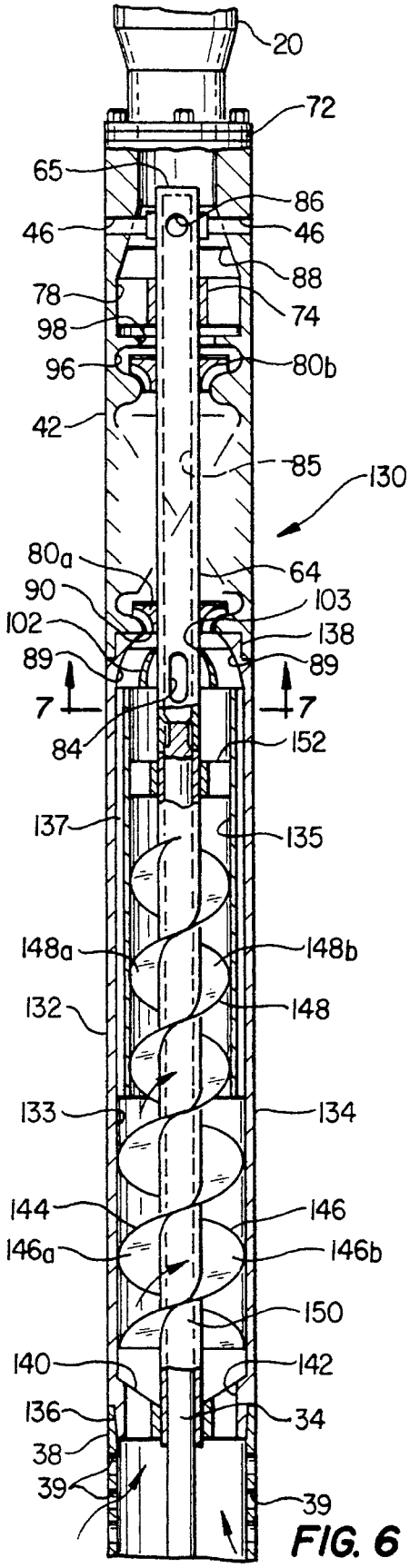
FIG. 6 is a longitudinal central section view of a second alternate embodiment of a submersible pump and gas-liquid separator in accordance with the invention.

Referring now to FIGS. 6 and 7, another embodiment of a gas-liquid separator for a downhole pump is illustrated wherein a pump 130 includes a pump section 42 connected to the tubing string 20 and a modified gas-liquid separator section 132 is interposed between the pump section 42 and the fluid inlet section 38. The gas-liquid separator section 132 includes a generally cylindrical tubular housing 134 connected to the inlet section 38 at a suitable joint 136 and to the pump section 42 at a suitable joint 138. The housing 134 includes an inlet end head portion 140 with suitable passages 142 formed therein for admitting a gas-liquid mixture into a flow path provided by a two-stage helical baffle 144. The baffle 144 has a first section 146 of a diameter which is greater than a second section 148. The baffle section 146 includes double helical baffle members **146*a* and 146*b* and the baffle section 148 also includes double helical baffle members 148*a* and 148*b*. The baffle 144 includes a central cylindrical tubular hub 150 which journals the pump shaft 34 and extends through a support web 152 similar to the web 60 of the embodiment of FIG. 1. The housing 134 also includes the stationary gas flow diverter 102 disposed Just upstream of a first stage impeller inlet opening 90**.

The housing 134 has a first flow passage defined by cylindrical housing wall 133 and a second flow passage defined by an inner cylindrical wall 135 which is spaced from and concentric with the wall 133 to provide a substantially annular passage 137. Suitable webs 139, FIG. 7, support the inner wall 135 in concentric spaced relationship with respect to the wall 133.

Effective separation of gas from liquid with a spiral or helical-type baffle is usually accomplished when the volume of gas in the fluid mixture is greater than about fifty percent. Accordingly, for a fluid mixture entering the pump 130 which has a gas content less than the aforementioned amount, effective separation of gas from liquid can be accomplished by a multi-stage type separator such as one characterized by a baffle like the baffle 144. Liquid which is centrifuged to the wall 133 of the housing 132 during flow through the first baffle section 146 enters the passages 137 and bypasses the baffle section 148 to flow directly through the passages 89 to the pump inlet opening 90. An annular core flowstream of a gas-liquid mixture with a higher percentage of gas then enters the separator section 148 whereby substantial separation of gas from liquid occurs before the flow streams approach the diverter 102. An annular flow stream of liquid flows into the passages 89 between the cylindrical wall 135 and the diverter 102 while gas is diverted to flow into the ports 84 and through the tubular shaft 64 for discharge through the ports 46 in the same operational manner as the pump 28.

Thanks to the provision of the helical baffles for the pumps 28, 106 and 130, fluid entering the pump impeller sections of these pumps is induced, prior to entry into the impellers **80*a*, to undergo spiral-type flow or pre-rotation which generally improves the operating characteristics of the multi-stage centrifugal pumps. The baffles of the separator sections 40 and 132 induce rotation in the fluid entering the respective pump impellers 80*a*** which is in the same direction as the direction of rotation of the impellers.

Figure 8:
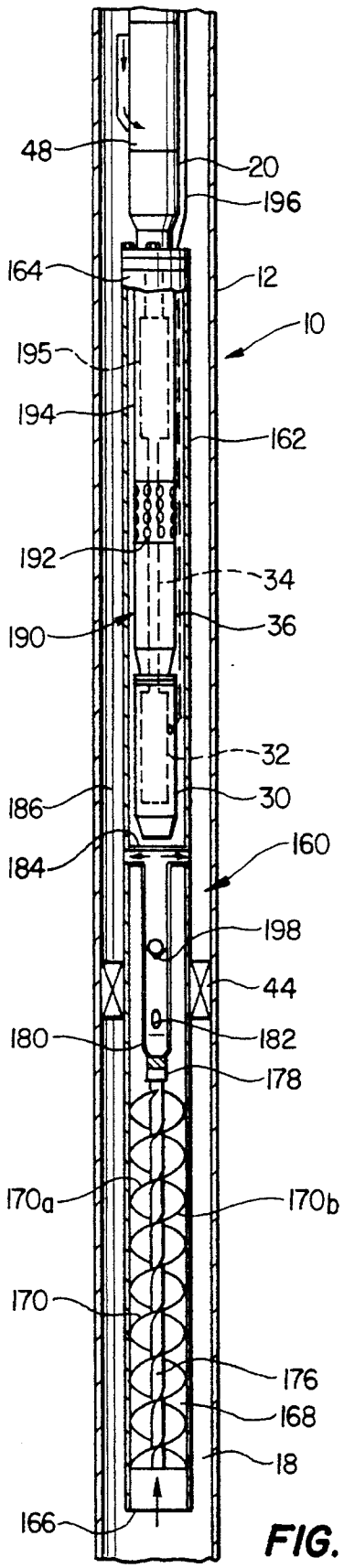
FIG. 8 is a longitudinal central section view of a third alternate embodiment of a downhole motor driven well pump with a gas-liquid separator in accordance with the invention.

Referring now to FIG. 8, yet another embodiment of a gas-liquid separator arrangement for a downhole well pump is shown disposed in the well 10 and generally designated by the numeral 160. In the arrangement shown in FIG. 8, a gas lift mandrel 48 is interposed in the tubing string 20 and the lower distal end of the tubing string 20 is connected to an elongated tubular housing 162 at a transverse flange 164 in a manner similar to the manner in which the tubing string 20 is connected to the pump sections 42 and 108. The housing 162 extends through a packer 44 and is open at a lower distal end 166 to admit a gas-liquid mixture into a passage 168 having a double helical stationary baffle 170 interposed therein with two spiral or helical flights **170*a* and 170*b*. The baffle 170 has a central hub portion 176 which is connected at its upper end 178 to a conduit 180 having one or more gas inlet ports 182 formed therein. The conduit 180 extends within the housing 162 in concentric relationship thereto and is connected to a crossover conduit 184 which opens into an annulus 186 within the casing 12 between the casing and the housing 162. Accordingly, a gas-liquid mixture within the wellbore 18 below the packer 44 flows into the housing 162 and gas and liquid are separated substantially by the helical baffle 170 whereupon gas flows along the hub 176 and enters the ports 182 to flow within the conduit 182 to the crossover conduit 184. Gas exits the crossover conduit 184 into the annulus 186 and flows upward toward the surface. As with the embodiment of FIG. 1, gas may be introduced back into the tubing string 20 through the gas lift mandrel 48, one or more of which may be interposed in the tubing string 20 between the housing 162 and the wellhead 14, not shown in FIG. 8**.

A conventional downhole submersible pump is interposed in the housing 162 between the tubing string 20 and the crossover conduit 184. The pump is generally designated by the numeral 190 in FIG. 8 and is characterized by a motor section 30, a thrust and protector section 36, a fluid intake section 192 and a conventional multi-stage centrifugal pump section 194 having suitable pump impeller means 195 disposed therein. The entire pump 190 may be a conventional electric motor driven submersible pump available from one of the aforementioned vendors. A suitable electrical conductor 196 extends through the casing 12, enters the housing 162 at the flange 164 through a suitable bulkhead fitting, not shown, and extends within the housing 162 to the motor section 30, as illustrated. A check valve 198 may be interposed in the conduit 180 between the ports 182 and the crossover conduit 184 to prevent backflow of fluid from the annulus 186 to the wellbore 18.

Accordingly with the arrangement illustrated in FIGURE 8, a gas-liquid mixture may be separated by the separator baffle 170 whereby gas may be drawn off into the annulus 186 through the conduits 180 and 184 while liquid flows through the housing 162 and enters the submersible pump 190 through the conventional inlet section 192. Liquid is pumped to the surface through the tubing string 20 while gas is conducted up the well annulus 186 and may be used to assist in lifting liquid through the tubing string at one or more gas lift mandrels 48.

Figure 9:
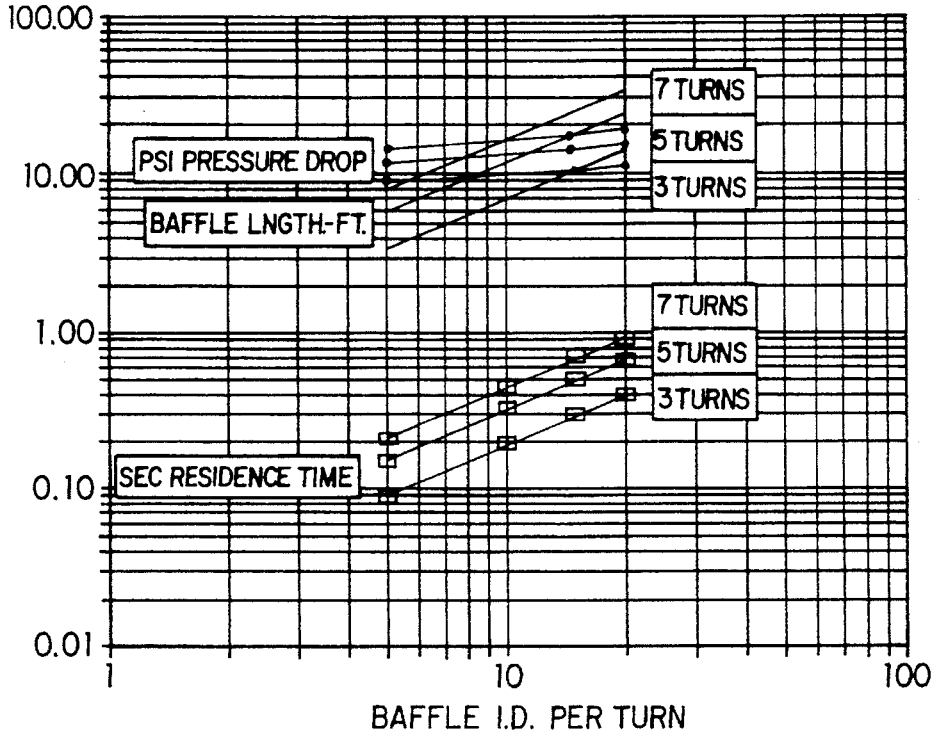
FIGS. 9 and 10 are diagrams illustrating certain characteristics of the gas-liquid separators.
Figure 10:
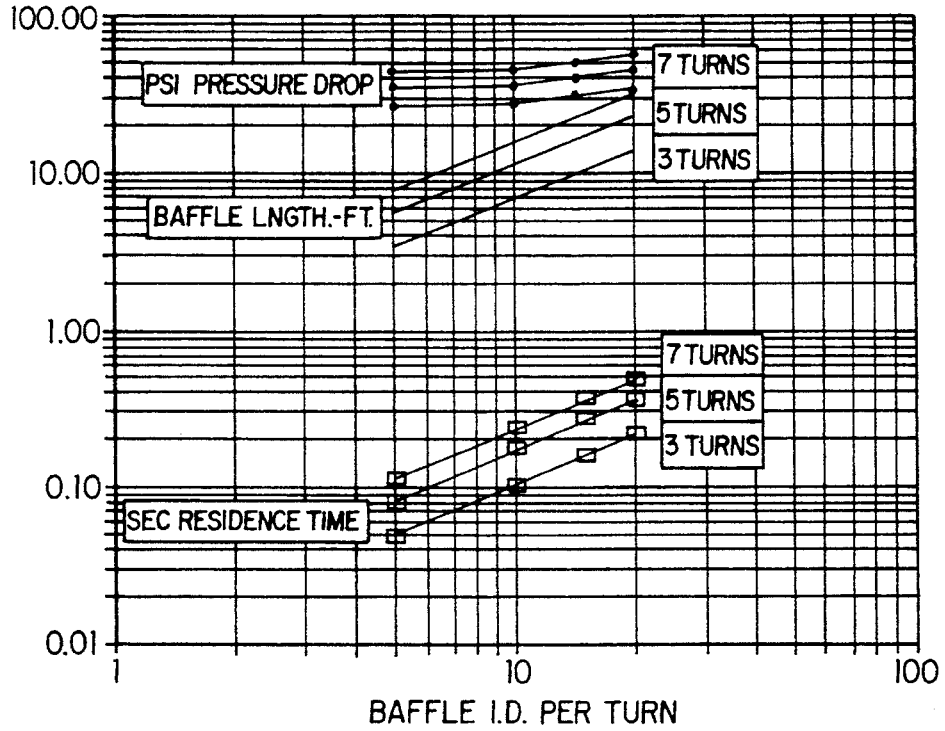

Separator pressure loss and separation effectiveness calculations for helical-type separators of the configurations described hereinabove may be carried out using conventional principles of fluid mechanics. FIGS. 9 and 10 illustrate diagrams indicating expected pressure losses for various lengths of helical separator baffles including baffles having selected numbers of complete turns about a longitudinal central axis. The parameters are plotted as a function of baffle pitch expressed as the number of inside diameters of the baffle per baffle turn. FIG. 9 indicates the characteristics shown for a mixture of crude oil and natural gas wherein the oil flow rate is estimated at 2200 barrels per day (forty-two U.S. gallons per barrel) and the gas flow rate is indicated at twenty million standard cubic feet per day. The crude oil is indicated to have an API gravity of 27. Conditions of pressure and temperature at the separator inlet are 2500 psia and 150° F. The calculations were made for a baffle plate thickness of 0.125 inches, an outside diameter of 2.75 inches and a hub diameter of 0.5 inches. The parameters for FIG. 10 are the same except the gas content is twice as great as for the conditions of FIG. 9, that is the gas flow rate is forty million standard cubic feet per day. FIGS. 9 and 10 indicate that pressure losses can be expected to range from about 10 psi to 56 psi for the above-mentioned flow conditions and for helical baffles having from three turns to seven turns and overall lengths of from about three and one-half feet to thirty feet.

The downhole pump and separator arrangements described hereinabove may be fabricated using conventional engineering materials and components used for downhole apparatus for hydrocarbon fluid producing wells. Except for the components described in detail herein, the sections of the pump including the motor section, thrust or protector section, and conventional components of the pumps identified are commercially available such as from the sources identified herein. Those skilled in the art will recognize also that various modifications and substitutions may be made to the invention without departing from the scope and spirit of the appended claims.

What is claimed is:

1. In a well pump for pumping fluids from a wellbore space through a tubing string to the surface, said pump including a motor section and pump means drivenly connected to said motor section for pumping liquid through said well to the surface, the improvement characterized by:

a gas-liquid separator including housing means connected to said pump and in communication with a gas-liquid mixture in a wellbore space of said well;

a substantially helical baffle interposed in said housing means and operable to receive a gas-liquid mixture and for effecting separation of said gas-liquid mixture into a gas flow stream and a liquid flow stream;

a conduit disposed downstream of said baffle in the direction of flow of fluid through said separator for conducting gas to bypass said pump; and said housing means defines a passage for admitting liquid to an inlet opening of said pump for pumping said liquid through said well toward the surface.

2. The invention set forth in claim 1 wherein:

said housing means includes an elongated tube having said baffle disposed generally at one end thereof, and said pump is disposed in said housing means between a tubing string extending within said well and said baffle for receiving liquid separated from said gas-liquid mixture.

3. The invention set forth in claim 2 wherein:

said housing means is connected to said tubing string and said pump includes a motor section and a pump section interposed in said housing means between said baffle and said tubing string.

4. The invention set forth in claim 1 including:

a well packer interposed in said well for separating a wellbore space in which gas-liquid mixture flows and a well annulus through which one of gas and liquid may be conducted from said pump to the surface.

5. The invention set forth in claim 1 wherein:

said housing means is interposed in said pump between said motor section and a pump impeller means and said motor section is drivingly connected to said impeller means by an elongated drive shaft extending through said housing means.

6. The invention set forth in claim 5 wherein:

said baffle includes a hub and said drive shaft extends through said hub and is drivingly connected to an impeller drive shaft for driving said impeller means.

7. The invention set forth in claim 6 wherein:

said impeller drive shaft comprises a hollow tube forming said conduit for conducting gas to bypass said pump.

8. The invention set forth in claim 7 including:

port means formed in said impeller drive shaft between said baffle and an inlet to said impeller means.

9. The invention set forth in claim 8 including:

a diverter disposed adjacent said port means for diverting gas flow exiting said baffle into said port means.

10. The invention set forth in claim 8 wherein:

said impeller drive shaft has a portion in flow communication with said tubing string for conducting gas to bypass said pump into said tubing string.

11. The invention set forth in claim 10 wherein:

said pump includes a passage in communication with said impeller means for communicating liquid from said pump into an annulus in said well.

12. The invention set forth in claim 1 wherein:

said baffle includes a first baffle section having a predetermined diameter and a second baffle section disposed downstream of said first baffle section in the direction of flow of fluid through said separator and having a diameter less than said first baffle section and means forming a liquid bypass passage between said first baffle section and impeller means of said pump for bypassing liquid flowing through said separator from said first baffle section directly to said impeller means.

13. The invention set forth in claim 1 including:

a gas lift mandrel interposed in a tubing string between said pump and a wellhead and operable to admit gas separated by said separator into said tubing string to assist in conveying liquid in said tubing string to said wellhead.

14. A gas-liquid separator for a downhole motor driven pump for pumping liquid from a well to the surface comprising:

an elongated tubular housing connected at an upper end to a tubing string extending within said well for conducting liquid to the surface;

a motor driven pump disposed in said housing including a motor section, a pump section and a pump fluid inlet section for receiving liquid flowing through said housing;

a spiral baffle interposed in said housing between said fluid inlet section and an opening for conducting a gas-liquid mixture into said housing, said baffle including a hub portion extending within said housing; and a conduit extending within said housing between said baffle and said pump including a gas inlet port and a gas discharge port for receiving gas within said housing separated from said gas-liquid mixture flowing through said baffle and for discharging separated gas into said well in an annular space between said housing and means defining a wellbore wall of said well.

15. The separator set forth in claim 14 wherein:

said housing extends through a packer interposed in said well and separating a wellbore space for receiving a gas-liquid mixture through said opening from an annular space between said housing and said wellbore wall.

16. The separator set forth in claim 14 wherein:

said tubing string includes at least one gas lift mandrel interposed therein and operable to receive gas separated from said gas-liquid mixture for entry into said tubing string between said pump and a wellhead of said well for assisting in lifting liquid in said tubing string toward said wellhead.

17. In a well pump for pumping fluids from a wellbore space through a tubing string to the surface, said pump being adapted to be connected to an elongated tubing string extending within said wellbore space and said pump including a motor section, a pump section and a separator section interposed between said motor section and said pump section and operable to receive wellbore fluids to effect separation of gas from liquid in a gas-liquid mixture flowing to said separator section from said wellbore space, said separator section comprising:

an elongated, generally tubular housing operably connected at one end to said pump section;

a substantially helical baffle interposed in said housing and non-rotatable with respect to said housing, said baffle being operable to direct a gas-liquid mixture through said housing to effect separation of said gas-liquid mixture into a gas flow stream and a liquid flow stream;

a passage formed in said housing and communicating liquid from said baffle to a fluid inlet of said pump section;

means forming a passage in communication with said baffle for directing a gas flow stream to bypass a pump impeller means disposed in said pump section; and said baffle including a hub portion extending within said housing and forming a passage for extension of a pump drive shaft interconnecting said motor section with said pump section for driving said impeller means.

18. The invention set forth in claim 17 wherein:

said impeller means includes an impeller drive shaft drivingly connected to said pump drive shaft and including a portion defining said passage means for conducting gas flow to bypass said impeller means.

19. The invention set forth in claim 18 wherein:

said impeller drive shaft includes port means formed therein and disposed between said baffle and said fluid inlet for receiving gas separated by said baffle from said gas-liquid mixture.

20. The invention set forth in claim 19 including:

a diverter disposed adjacent to said port means for diverting gas separated from said gas-liquid mixture to flow through said port means.

21. The invention set forth in claim 18 wherein:

said impeller drive shaft has a portion in flow communication with said tubing string for conducting gas from said impeller drive shaft into said tubing string.

22. The invention set forth in claim 21 wherein:

said pump section includes a passage in communication with said impeller means for communicating liquid from said pump section into an annulus of said well.

23. The invention set forth in claim 17 wherein:

said baffle includes a first baffle section having a predetermined diameter and a second baffle section axially spaced from said first baffle section in a direction downstream of said first baffle section with respect to the direction of flow of fluid through said separator section, said second baffle section having a diameter less than said first baffle section, and means forming a liquid bypass passage between said first baffle section and said impeller means for conducting liquid flowing through said separator section from said first baffle section directly to said impeller means.

24. The invention set forth in claim 17 including:

a gas lift mandrel interposed in said tubing string between said pump section and a wellhead and operable to admit gas separated by said separator section into said tubing string to assist in conveying liquid in said tubing string to said wellhead.

* * * * *